United States Patent [19]

Veenman

[11] Patent Number: 4,711,355

[45] Date of Patent: Dec. 8, 1987

[54] STACKABLE BOX

[76] Inventor: Simon J. M. Veenman, P.O. Box 160, 2690 AD 's-Gravenzande, Netherlands

[21] Appl. No.: 778,562

[22] Filed: Sep. 20, 1985

[30] Foreign Application Priority Data

Sep. 27, 1984 [NL] Netherlands ..... 8402955
Oct. 29, 1984 [NL] Netherlands ..... 8403273

[51] Int. Cl.[4] ..... B65D 21/02

[52] U.S. Cl. ..... 206/503; 206/511; 206/512; 206/821

[58] Field of Search ..... 206/503, 511, 512, 821; 211/126

[56] References Cited

U.S. PATENT DOCUMENTS 1,951,972 3/1934 Fraser ..... 206/821
2,894,640 7/1959 Bigelow ..... 211/126
3,283,915 11/1966 Maslow ..... 211/126
4,225,046 9/1980 Ettema ..... 206/821

FOREIGN PATENT DOCUMENTS 1304633 8/1962 France ..... 206/821

*Primary Examiner*—George E. Lowrance
*Attorney, Agent, or Firm*—Fred Wiviott

[57] ABSTRACT

Stackable box for receiving objects, provided with a bottom, whether or not detachable, and upright side walls comprising side and transverse walls which join each other in corner points, the box being provided with detachable extension pieces having legs extending upwardly from the side walls, each extension piece also being provided with a pair of wings, each wing extending parallel to the side walls joining each other in a relevant corner point and taken up at least with their bottom ends in recesses made in said side walls.

16 Claims, 13 Drawing Figures

STACKABLE BOX

The invention relates to a stackable box for receiving objects, provided with a bottom, whether or not detachable, and upright side walls comprising side and transverse walls which join each other in corner points, the container being provided with detachable extension pieces having legs extending upwardly from the side walls.

Such boxes, as e.g. known from GB-A- 2.008.077 and usually made of synthetic material, are e.g. used for receiving objects, such as vegetables, fruit, plants and the like. To enable stacking on each other of filled boxes while avoiding damaging of the objects in the boxes it is usually necessary that the extension pieces have a comparatively great length to keep distance between the objects in a certain box and the bottom of the box thereabove.

With the box known from GB-A- 2.008.077 now the connection between an extension piece and the box is effected by means of a corner column extending somewhat above the upper edge of the side walls, said corner column extending into a recess made in the bottom end of the extension piece. The connection obtained in this manner between extension piece and box is not particularly solid, so that, in particular when transverse forces are being applied to a stack of boxes, provided with such extension pieces, e.g. during transport, the extension pieces can collapse relatively to the boxes, the boxes falling on each other and the products in the boxes being damaged.

The purpose of the invention now is to obtain a stackable box of the above-mentioned kind, having such a construction that a solid and yet easily detachable connection between the boxes and the extension pieces can be obtained.

According to the invention this can be achieved because each extension piece is provided with a pair of wings, each extending parallel to the side walls joining each other in a relevant corner point and taken up at least with their bottom ends in recesses made in the side walls.

The wings making an angle with each other and taken up in recesses made in the side walls provide an effective solid connection between box and extension piece.

It is noted that, from U.S. Pat. No. 3,651,977 a box is known which is provided at its upper end with an outwardly extending flange. For mounting corner pieces on the flange holes have been provided in the flange through which pins attached to the corner pieces can be passed. The corner pieces are intended to secure a further box placed on the flange of the box against displacement relatively to the box first-mentioned. Extension pieces according to the invention, suitable for supporting boxes in spaced positions, however, are not known from said reference.

According to an efficient embodiment of the invention a pair of extension pieces are mutually connected by means of a connecting portion. Such a connecting portion contributes advantageously to the rigidity of the box, whilst the connecting portion also serves as further bounding wall portion for protecting the contents of the box.

The invention will be more fully explained hereinafter with reference to some examples of the construction according to the invention illustrated in the accompanying figures.

Figure 1:
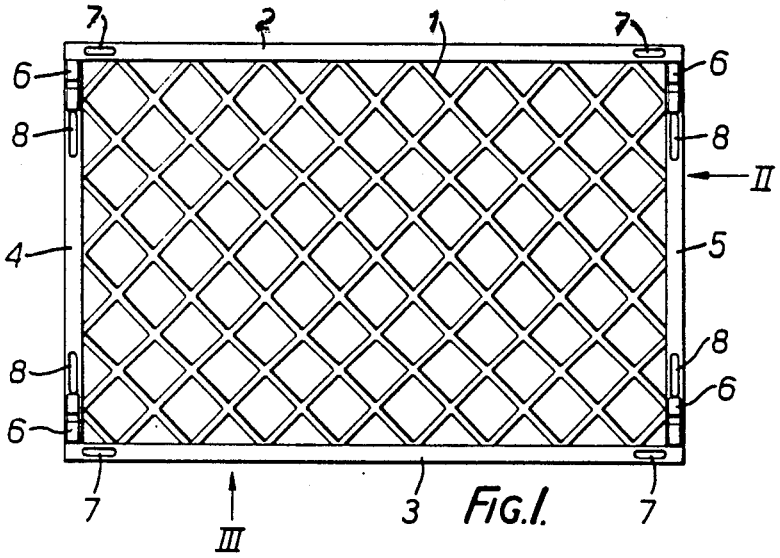
FIG. 1 is a top view of a box without extension pieces
Figure 2:
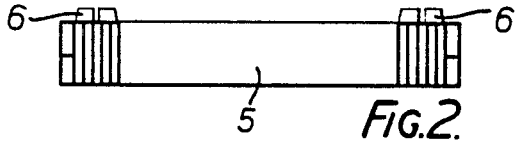
FIG. 2 is a side view of FIG. 1, seen according to the arrow II in FIG. 1.
Figure 3:
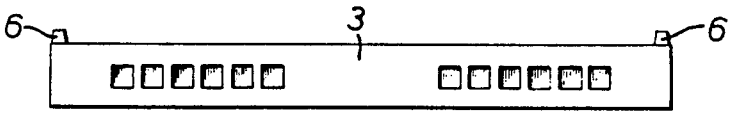
FIG. 3 is a side view of FIG. 1, seen according to the arrow III in FIG. 1.

FIGS. 1–3 illustrate a container according to the invention, said box being provided with a bottom 1, grate-shaped in this embodiment, and upright side walls formed by longitudinal walls 2 and 3 and transverse walls 4 and 5. In the embodiment illustrated the longitudinal and transverse walls extend, as usual, perpendicularly to each other, but within the spirit and extent of protection of the invention it will also be imaginable that said side longitudinal and transverse walls form a different angle with each other.

Furthermore it will be apparent, that instead of a grateshaped bottom also e.g. a closed bottom can be applied, the bottom possibly being fixed to the side walls or being detachable.

Such boxes are usually made of synthetic material, the side walls 2–5 usually being made double walled and having, in cross-sectional view, the shape of a U turned upside down.

As further appears from the figures corner columns, in cross section angular, have been provided near the ends of the transverse walls 4 and 5 connecting to the longitudinal walls 2 and 3, said corner columns tapered off somewhat upwardly in the illustrated embodiment.

Furthermore the horizontally tapering upper parts of the walls 2 and 3 have been provided near the corner points with slotted holes 7 extending in the longitudinal direction of said walls. In a similar manner slotted holes 8 have been provided near the corner columns in the transverse walls 4 and 5.

In combination with the box described herinabove extension pieces (FIG. 6) can be used. such an extension piece, preferably also made of synthetic material, comprising a leg, which in the illustrated embodiment example is constructed from strip-shaped parts 10 extending parallel to each other and extending perpendicularly to a vertically extending plate-shaped part 11. The strip-shaped parts 10 have been joined with their bottom ends to a plate-shaped part 12 extending perpendicularly to the plate-shaped part 11, said part 12 joining said part 12 at some distance above the bottom end of the plate-shaped part 11. Joined to the boundary edge of the plate-shaped part 12 turned away from the plate shaped part 11 is a plateshaped part 13 extending downwardly from said edge. The outer strip-shaped parts 10 are provided with extensions extending under the plate-shaped part 11, which connect the ends of the plate-shaped part 13 with the bottom end of the plate-shaped part 11. Thus the bottom end of the plate-shaped part 11 defines, with the plate-shaped part 13 and the bottom ends of the outer strip-shaped parts 10, lying under the plate-shaped part 12, a cavity dimensioned in such a manner that a corner column 6 fits therein.

Figure 6:
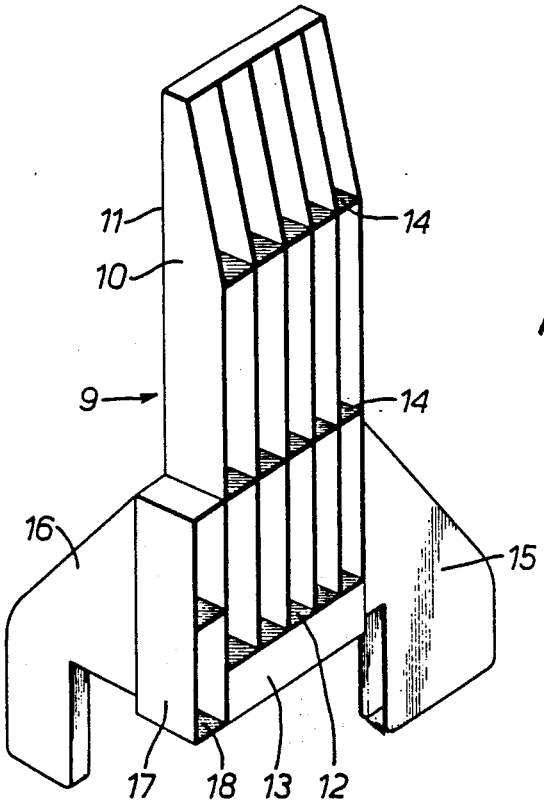
FIG. 6 is a perspective view of an extension piece

As further appears from FIG. 6 connecting ribs 14 have been provided, regularly spaced between the strip-shaped parts 10, for stiffening of the leg of extension piece 9 formed by the parts 10–14.

Seen in FIG. 6 a wing 15 has been joined to the right-hand strip-shaped part 10, said wing 15 extending parallel to the plate-shaped part 11 and being provided with a more or less rectangular part extending under the bottom ends of the plate-shaped parts 11 and 13. A wing 16, shaped more or less similarly and extending perpendicularly to said wing 15 is connected with the leg of the extension piece at the side of said leg turned away from the wing 15. The connection between said wing 16 and an outer strip-shaped part 10 has been effected by means of a plate-shaped part 17 extending parallel to said strip-shaped part 10, said plate-shaped part 17 being connected with said strip-shaped connecting part by means of connecting ribs 18.

The embodiment of the extension piece described hereinabove has been chosen to obtain an extension piece as light and solid as possible which can be made of synthetic material. Of course other shapes are also possible, as long as the extension piece is provided at its bottom end with a cavity for accommodating a corner column 6 and the more or less rectangular made bottom ends of the wings 15 and 16, positioned perpendicularly to each other, protrude under the leg of the extension piece.

As further appears from FIG. 6 the upper end of the leg 6 of the extension piece tapers off in a similar manner as the corner column.

Also widthwise, i.e. seen in FIG. 2 the corner column tapers off somewhat upwardly and similarly also the width of the upper part of the leg of an extension piece will decrease somewhat upwardly.

Figure 7:
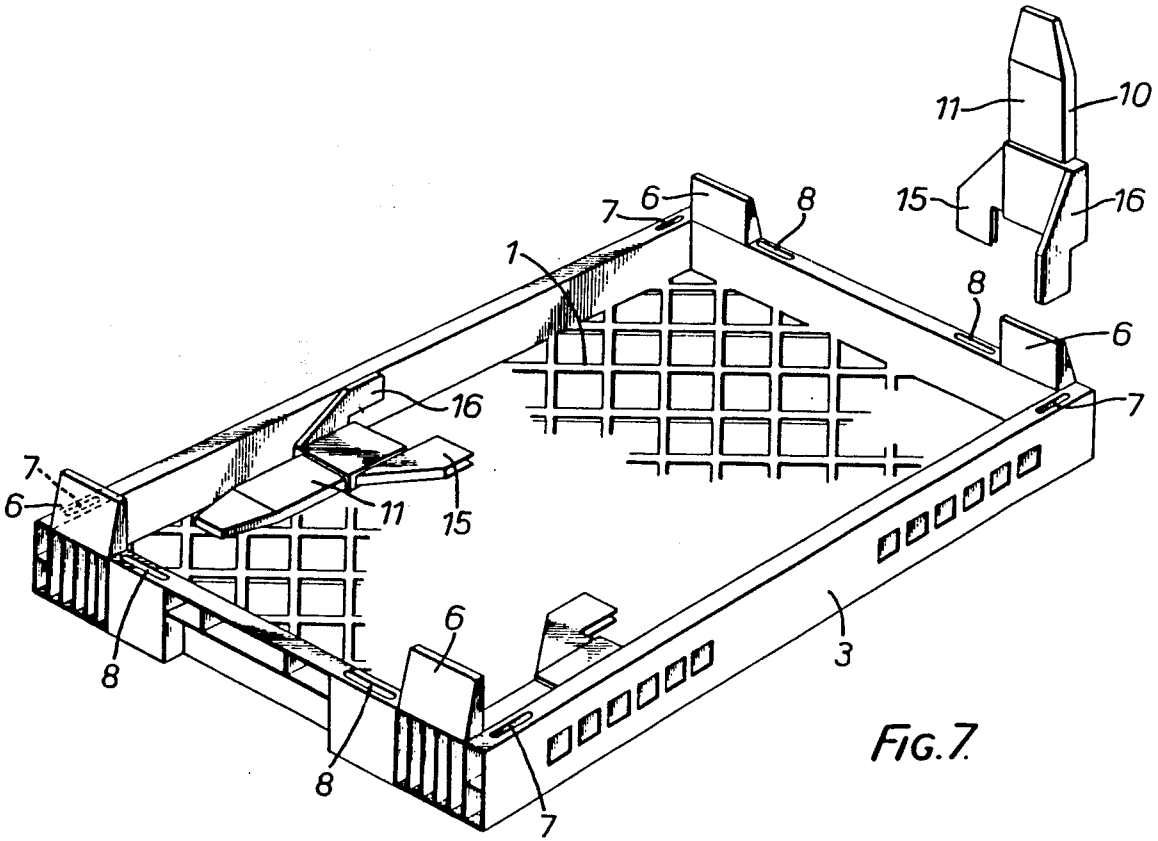
FIG. 7 shows in perspective a container.

As is diagrammatically illustrated now in the right-hand part of FIG. 7 an extension piece can be mounted on a box perpendicularly from above, the corner column 6 being accommodated in the recess made in the bottom end of the leg of the extension piece, the bottom end of the leg in question resting on the upper edges of the side walls and the rectangular parts of the wings 15 and 16 which protrude under the leg being accommodated, via the openings 7 and 8 in the recesses made in the side walls for this purpose. It will be apparent, that thus a solid connection between the extension piece and the box has been obtained, the extension piece at the same time being secured against displacement relatively to the box and a vertically directed force applied to an extension piece being efficiently transferred to the part of the box under the extension piece. It is remarked that it will also be apparent from FIG. 7 that the two extension pieces, provided near the corner points of a short side, will form each other's mirror image.

Preferably the recesses made in the side walls for the wings 15 and 16 are open at their bottom ends, so that no dirt can accumulate in said recesses.

As is further illustrated in FIG. 7 an extension piece is preferably formed in such a manner that it can be put flat on the bottom of the box without a wing protruding above the edge of the side walls.

Figure 4:
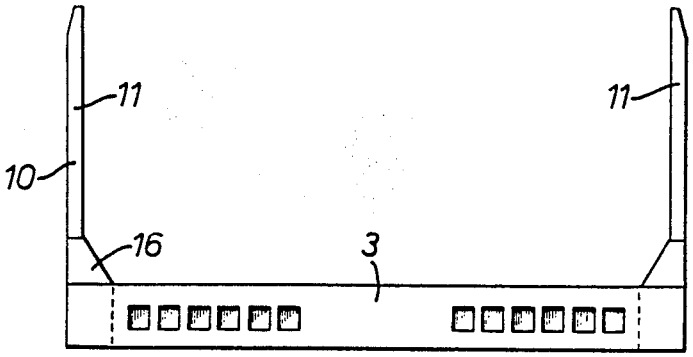
FIG. 4 is a side view corresponding with FIG. 3, the box being provided with extension pieces.
Figure 5:
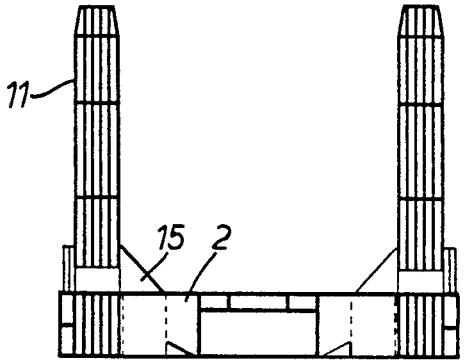
FIG. 5 is a side view of FIG. 4.

FIGS. 4 and 5 show a view on a box provided with extension pieces. As will be apparent from a comparision of the extension piece illustrated in FIG. 6 with the extension pieces illustrated in FIGS. 4 and 5 the legs of the extension pieces can be constructed with several lengths.

Figure 8:
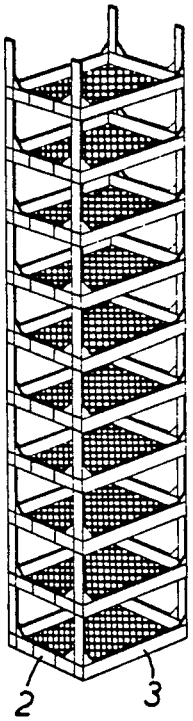
FIG. 8 shows a number of containers, stacked on each other, provided with extension pieces

The box described above can be used separately, possibly without extension pieces. When provided with extension pieces, the boxes can be stacked on each other, as illustrated in FIG. 8. Then the tapered off upper ends of the extension pieces are accommodated in recesses made in the relevant transverse walls of the box under the corner pieces 6 of a box higher up.

When the boxes are stacked on each other in the manner illustrated in FIG. 8 by means of the extension pieces the forces applied to boxes lower down by boxes higher up will be efficiently taken up and transferred via the legs of the extension pieces and the corner pieces.

The transfer of the force is optimal because no break has been made in the corner part, such as a hollowing for accommodating a removable spacing piece or the like.

Figure 9:
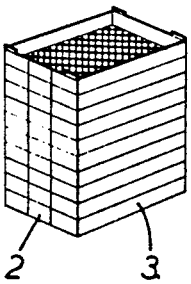
FIG. 9 shows a number of containers, stacked on each other, no use being made of extension pieces

After removal of the extension pieces, which can then possibly be laid in the box, the boxes can be stacked, in the manner illustrated in FIG. 9, e.g. for transport and/or storage. Then the corner pieces 6 of a box lower down will be accommodated in the aforementioned recesses made in the side walls under the corner pieces 6 of a box higher up. It will be apparent that in this manner the boxes in the position suited for transport and storage take up little room in comparision with the volume, which the boxes provided with extension pieces take up, as illustrated in FIG. 8.

The floor space taken up by a stack of boxes in the stack according to FIG. 8 is equal to the required floor space in the stack according to FIG. 9.

Hereinabove mention has always been made of boxes. However, it will be apparent that this should be given a wide interpretation as transport means for objects. Thus a lowest box or container can be provided with wheels, so that a number of boxes or containers stacked on each other are movable.

Also it is possible to construct the container or box with detachable or hinging walls.

Naturally the box or the like can be given any desired form or bottom surface.

Within the spirit and extent of protection of the invention, therefore, many variations and/or additions to the construction described hereinabove are imaginable.

Figure 10:
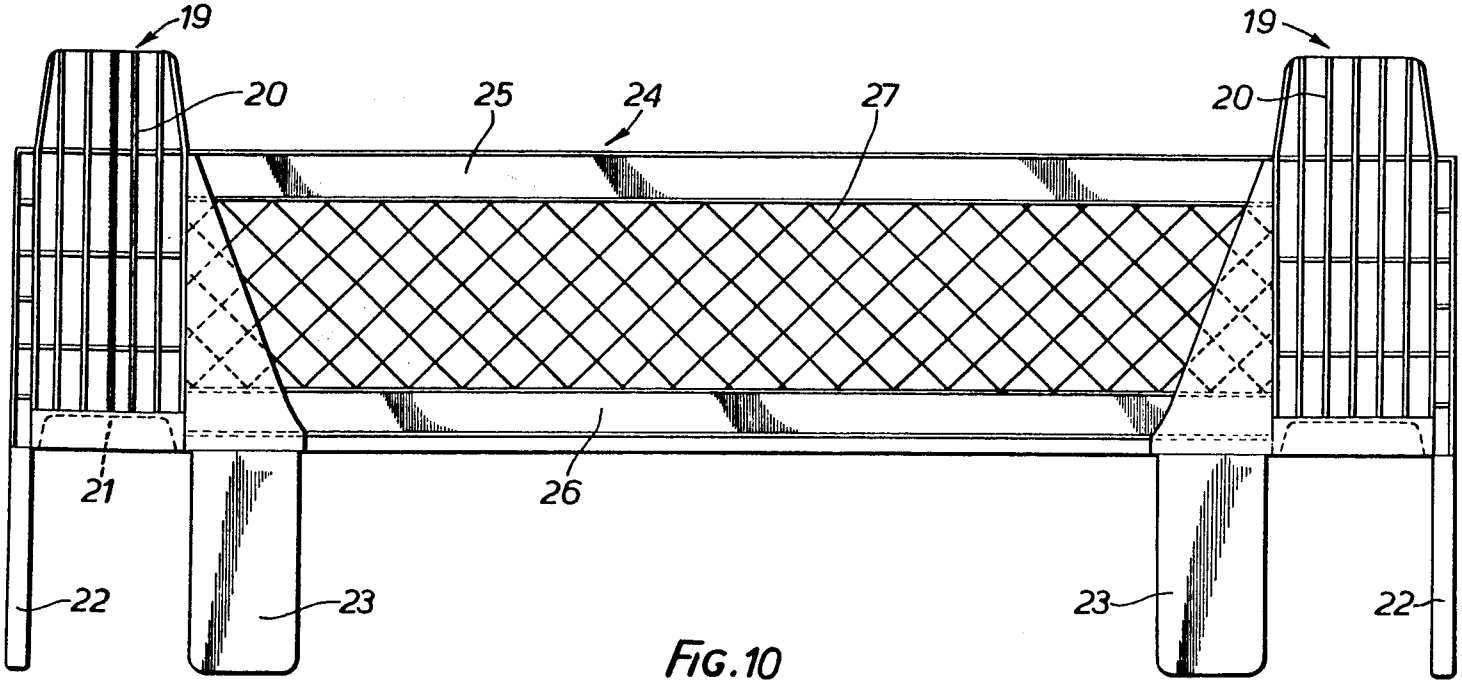
FIG. 10 is a side view of a pair of extension pieces connected with each other by means of a connecting portion.
Figure 11:
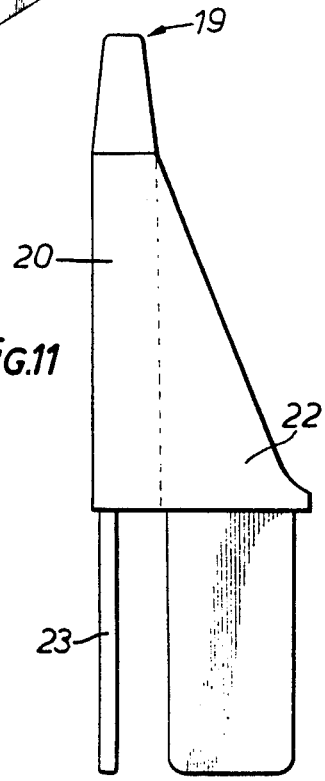
FIG. 11 is a side view of FIG. 10.

In combination with the box described hereinabove it is possible e.g. to use extension pieces 19 as illustrated in FIGS. 10 and 11. Such an extension piece, preferable also made of synthetic material, comprises a leg 20, the upper end of which tapers off in a similar manner as a corner column. In the bottom end of the leg 20 a recess 21 has been made, whose shape is such that in said recess 21 can be accomodated, a corner column 6 or the upper end of a leg 20 of another extension piece respectively. Joined to the sides of the leg 20 are a pair of wings 22, 23 respectively, whose rectangular bottom ends protrude under the leg 20, as is apparent from FIGS. 10 and 11. Thereby said wings 22 and 23 are perpendicular relatively to each other in the illustrated embodiment.

As is further apparent from FIG. 10 a pair of extension pieces are here mutually connected by means of a connecting portion 24, made of one piece with the two extension pieces 19 connected by this connecting portion 24. In the illustrated embodiment the connecting portion is built up from a pair of having a U-shaped cross-section profiles 25 and 26, and a wall portion 27 positioned between said profiles, which can be formed by a closed plate-shaped part or by a grate-shaped part.

The extension pieces 19 thus connected with each other can be placed on the box as illustrated in FIGS. 1–3, in such a manner that the bottom ends of the wings 23 are inserted in the holes 8 and the bottom ends of the wings 22 in the holes 7. Thereby the corner columns 6 will fall into the recesses 21, whilst the connecting portion 24 will form a heightening of the transverse wall 4, 5 respectively above each of which a similar connecting portion with the extension pieces belonging to it will be placed.

A further box can then be placed on the upper ends of the extension pieces 19 and thus a stack can be formed from a number of boxes filled with objects, said boxes being provided with extension pieces 19 mutually connected by means of the connecting portions described hereinabove.

For empty transport of the boxes the extension pieces with the connecting portions 24 connecting the extension pieces can be detached from the boxes and put in the boxes, in such a manner that the connecting portions 24 will rest on the bottom of the boxes. The construction has been made such that in such a position the wings 22 do not protrude above the side walls 2–5 of the box, so that the empty boxes can also be efficiently stacked on each other.

It is further remarked that also here the recesses made near the bottom ends of the corner columns 6 at the bottom side of the box are suited for accommodating the corner columns of an underlying box or the upper ends of the extension pieces 19 of an underlying box respectively.

It will be apparent that the connecting portion 24 effects a good connection between extension pieces 19 provided in pairs to corner points of the box, so that the connecting portion 24 contributes to the rigidity of the box. At the same time said connecting portion forms a heightening of the relevant side wall of the box above which the connecting portion has been placed.

Because of the solid connection between the two extension pieces 19 obtained by means of the connecting portion 24 it is possible, if desired, to refrain from using the portions of the wings 23 that protrude under the legs 20, so that then only the bottom ends of the wings 22 have to be inserted in the relevant holes 7, whilst they still sufficient rigidity of the box and cohesion between the parts can be ensured. With such an application it is naturally also possible to leave out the holes 8 in the transverse walls 4 and 5.

Figure 12:
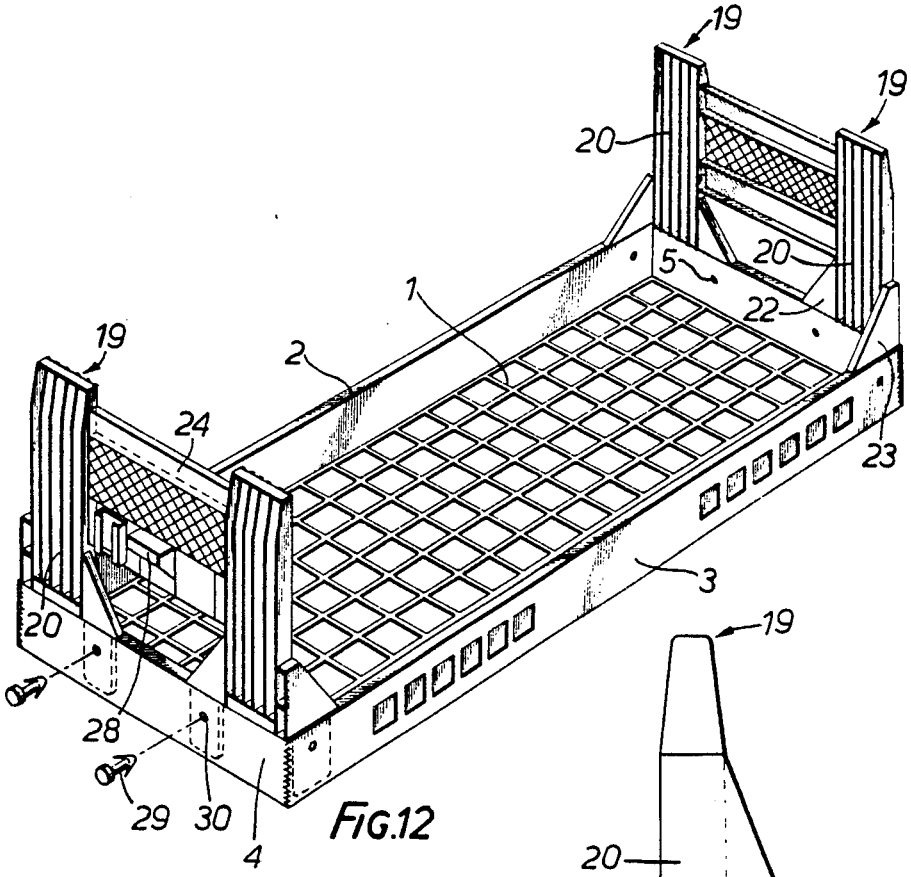
FIG. 12 shows in perspective a further example of a container with mutually connected extension pieces mounted thereon.
Figure 13:
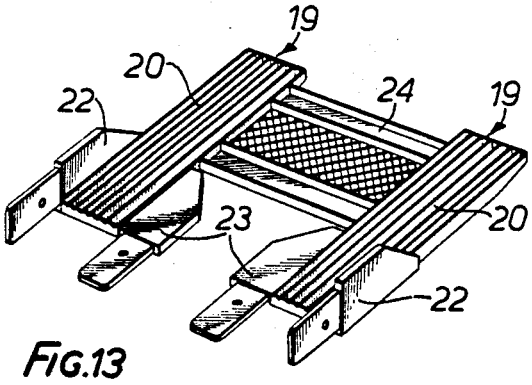
FIG. 13 shows in perspective a pair of mutually connected extension pieces, as used in the box illustrated in FIG. 12.

A variation on the embodiment described hereinabove is illustrated in FIGS. 12 and 13. The parts illustrated in said FIGS. 12 and 13, which correspond with parts of the embodiment described hereinabove are provided with the same reference figures as used in FIGS. 1–3 and 10.

As will be apparent from FIGS. 12 and 13 the legs of the extension pieces are constructed longer here than the legs of the extension pieces illustrated in FIGS. 10 and 11, whilst the connecting portions between the upper ends of the extension pieces are mounted such that there is an open space between the upper edges of the transverse walls 4 and 5 and the bottom edges of the connecting portions 24. In this embodiment the connecting portions 24 are provided with grips 28 for carrying the box. In order to prevent that on carrying the box the extension pieces 19 become detached from the box use may be made of pins 29, which can be put through holes 30 made in the side walls of the box and the bottom ends of the wings 22 and/or 23.

According to a further variation on the invention grooves can be hollowed out in the facing ends of the wings resting on transverse walls 2 and 3 or in the facing boundary planes of the legs of the extension pieces lying above the transverse walls 4 and 5 for accommodating the ends of further extension pieces extending between the transverse walls 4 and 5 and forming extensions of the longitudinal walls 2 and 3, so that by means of said plate-shaped parts and the connecting portions 24 a closed space in the extension of the side walls of the box can be created.

It will also be imaginable to make slots in the box, preferably near the corner points through which the wings can be put when the extension pieces have been detached.

The width of the wings can then be made greater than the height of the side walls whilst the empty boxes can still be stacked on each other. Only in the lowermost box it will not be possible to accommodate extension pieces, but the extenstion pieces of the lowermost box can then be put in the uppermost box of the stack.

I claim:

1. A stackable box for receiving objects, said box having a bottom and upright transverse and longitudinal sidewalls, said sidewalls having upper exposed surfaces and intersecting with one another at a common corner point, a recess in the exposed upper surface of each wall in the proximity of the said corner point, a detachable extension piece at said corner point, said extension piece having a bottom surface resting on the said upper exposed surfaces between said recesses and a pair of integral wings, each wing of said pair extending parallel with a respective sidewall and defining with said extension piece a registering common corner point and each having a portion extending downwardly and arranged to be inserted in and received by a respective recess.

2. Box as claimed in claim 1, characterised in that near the corner points corner columns extending above the side walls have been provided, such that a leg of the extension piece is positioned in the extension of a corner column.

3. Box as claimed in claims 1 or 2, characterised in that a recess made in the side wall is open at its bottom side.

4. Box as claimed in claims 1 or 2, characterised in that the wings of an extension piece are substantially perpendicular to each other.

5. Box as claimed in claims 1 or 2, characterised in that under every corner column in the box a recess has been made for accommodating the corner column of an underlying box or the upper end of a leg of an extension piece of an underlying box respectively.

6. Box as claimed in claims 1 or 2, characterised in that the corner column tapers off somewhat upwardly and the upper end of the leg of an extension piece which tapers off in a similar manner.

7. Box as claimed in claims 1 or 2, characterised in that the height of a leg and a wing joined to it is such, that when an extension piece with its leg lies on the bottom of the box said wing does not protrude above the side walls of the box.

8. Box as claimed in claims 1 or 2, characterised in that a wing of an extension piece is positioned in the extension of the single leg of the extension piece and the other wing extends at least substantially perpendicularly to said leg.

9. Box as claimed in claims 1 or 2, characterised in that a pair of extension pieces are mutually connected by a connecting portion.

10. Box as claimed in claim 9, characterised in that a connecting portion forms a wall portion extending above a relevant side wall.

11. Box as claimed in claim 9 characterised in that the combination of extension pieces and a connecting portion is only provided with wings, the bottom ends of which are accommodated in recesses, made in side walls extending transverse to the connecting portion.

12. Box as claimed in claim 9, characterised in that the connecting portion is positioned at some distance of a side wall extending under said connecting portion.

13. Box as claimed in claim 9, characterised in that a connecting portion is provided with a grip.

14. Box as claimed in claim 9, characterised in that in the side walls and in the parts of the wings, which are inserted in the recesses made in the side walls, passages have been made aligning with each other and through which a pin has been passed.

15. Container as claimed in claims 1 or 2, characterised in that extension pieces are provided with grooves for accommodating the ends of a plate-shaped part to be provided between facing extension pieces.

16. Container as claimed in claims 1 or 2, characterized in that slots have been made in the bottom of the box for the passage of the wings of the extension pieces.

* * * * *